US008922343B2

(12) United States Patent
Inagawa et al.

(10) Patent No.: US 8,922,343 B2
(45) Date of Patent: Dec. 30, 2014

(54) REMOTE OPERATION APPARATUS OF WORKING MACHINE

(75) Inventors: Toshinori Inagawa, Wako (JP); Toshikazu Nakamura, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 834 days.

(21) Appl. No.: 12/775,722

(22) Filed: May 7, 2010

(65) Prior Publication Data

US 2010/0283625 A1 Nov. 11, 2010

(30) Foreign Application Priority Data

May 8, 2009 (JP) ..... 2009-113485

(51) Int. Cl.
*G08C 19/16* (2006.01)
*G08C 17/00* (2006.01)

(52) U.S. Cl.
CPC ..... *G08C 17/00* (2013.01); *G08C 2201/10* (2013.01); *G08C 2201/50* (2013.01); *G08C 2201/12* (2013.01)
USPC ..... 340/6.1; 340/426.15

(58) Field of Classification Search
CPC ..... G08C 19/16; G08C 19/28; G08B 5/22
USPC ..... 340/6.1, 426.15, 426.16, 426.17, 539.3
See application file for complete search history.

(56) References Cited

U.S. PATENT DOCUMENTS

| | | | | |
|---|---|---|---|---|
| 5,909,183 | A * | 6/1999 | Borgstahl et al. | 340/12.29 |
| 6,273,771 | B1 * | 8/2001 | Buckley et al. | 440/84 |
| 2005/0253682 | A1 | 11/2005 | Kato | |
| 2005/0285552 | A1 * | 12/2005 | Grubba et al. | 318/268 |
| 2007/0080780 | A1 * | 4/2007 | Shen | 340/5.61 |
| 2008/0020656 | A1 * | 1/2008 | Yamada et al. | 440/1 |
| 2008/0258870 | A1 | 10/2008 | Sugiura | |
| 2009/0037040 | A1 | 2/2009 | Salmon | |

FOREIGN PATENT DOCUMENTS

| | | |
|---|---|---|
| JP | 8-019866 | 2/1996 |
| JP | 3128214 | 12/2006 |

* cited by examiner

*Primary Examiner* — Edwin Holloway, III
(74) *Attorney, Agent, or Firm* — Rankin, Hill & Clark LLP

(57) ABSTRACT

In a remote operation apparatus of a working machine including a working machine side transmission/reception unit (21) and a radio remote operation means (3) having a remote control side transmission/reception unit (31), an ON/OFF control circuit (32) for controlling the operation/non-operation state of the remote control side transmission/reception unit (31) is disposed to the radio remote operation means (3), and the working machine side transmission/reception unit (21) is called when the remote control side transmission/reception unit (31) is in an operating state by that the ON/OFF control circuit (32) is turned on, and the data showing the driving state of the working machine (1) is transmitted from the working machine side transmission/reception unit (21) to the remote control side transmission/reception unit (31) to thereby reduce an electric power consumption amount on the radio remote operation means (3).

10 Claims, 8 Drawing Sheets

TRANSMISSION SIGNAL OF THE REMOTE CONTROLLER PORTABLE UNIT (a)

| ID CODE | COMMAND | CHECK SUM |
|---|---|---|

↑"COMMAND" HAS THE INFORMATION OF A RESPONSE REQUEST TIME

TRANSMISSION SIGNAL OF THE REMOTE CONTROLLER INSTALLATION UNIT (b)

| ID CODE | COMMAND | ACTUAL MACHINE INFORMATION | CHECK SUM |
|---|---|---|---|

REMOTE OPERATION APPARATUS OF WORKING MACHINE

TECHNICAL FIELD

The invention relates to a remote operation apparatus of a working machine such as a generator having an engine which is remotely controlled by a radio remote operation means (a remote controller), and particularly to a remote operation apparatus of a working machine for saving electric power on a remote controller side bynot performing transmission/reception all the time, between the remote controller side and the working machine side.

BACKGROUND ART

For example, Patent Document 1 discloses a proposal of an apparatus capable of remotely controlling an engine generator by constantly displaying engine information on a load side via an output cable connecting the engine generator to the load.

Further, Japanese Utility Model Registration No. 3128214 proposes an apparatus for starting and stopping construction machines such as a construction machine generator, a construction machine compressor, and a construction machine welder by a remote operation using a remote controller for performing a radio communication.

[Patent Literature 1] Japanese Patent Application Publication No. 8-19866

[Patent Literature 2] Japanese Utility Model Registration No. 3128214

SUMMARY OF INVENTION

Technical Problem

However, when the remote operation and the engine information display of the engine generator, which are performed by a wired remote controller as disclosed in Patent Document 1, are to be performed by a radio remote controller as disclosed in Patent Document 2, the radio remote controller must be placed in a receiving state at all times to receive the information from the engine generator and monitor the operating state of the engine generator side on the radio remote controller side. Accordingly, a problem arises in that it becomes difficult to use the radio remote controller for a long time because an electric power consumption amount increases.

An object of the invention, which was proposed in view of the above circumstances, is to provide a remote operation apparatus of a working machine having an engine capable of reducing an electric power consumption of a radio remote controller (radio remote operation means) side when the working machine is remotely operated by the radio remote controller.

Solution to Problem

To achieve the object, in a remote operation apparatus of a working machine which includes an operation controller (14) for controlling various operations of the working machine (1) having an engine, a working machine side transmission/reception unit (21) disposed to the working machine side, and a radio remote operation means (3) having a remote operation side transmission/reception unit (31) for performing transmission/reception with the working machine side transmission/reception unit (21), the remote operation apparatus of the working machine includes the following arrangements: an ON/OFF control circuit (32) for controlling the operation/non-operation state of the remote control side transmission/reception unit (31) is disposed to the radio remote operation means (3) ; and the working machine side transmission/reception unit (21) is called when the remote control side transmission/reception unit (31) is in an operating state by that the ON/OFF control circuit (32) is turned on, and the data showing the driving state of the working machine (1) is transmitted from the working machine side transmission/reception unit (21) to the remote control side transmission/reception unit (31).

In further accordance with the present invention, the remote operation apparatus of the working machine comprises:

- the ON/OFF control circuit (32) includes a timer (321) and a storage unit (322) for controlling timing of transmission/reception between the working machine side transmission/reception unit (21) and the remote control side transmission/reception unit (31); and
- the transmission/reception between the working machine side transmission/reception unit (21) and the remote control side transmission/reception unit (31) is intermittently performed by operating the remote control side transmission/reception unit (31) at a transmission/reception interval previously set to the storage unit (322)

In further accordance with the present invention, the radio remote operation means (3) comprises:

- a display unit (33) for displaying the data received by the remote control side transmission/reception unit (31); and
- an operation unit (34) for at least stopping the engine.

In further accordance with the present invention, the radio remote operation means (3) has a function for temporarily stopping the functions other than the function for operating the timer (321) and the display unit (33) until the timing of next transmission/reception performed by the storage unit (322) after the radio remote operation means (3) receives the data showing the operating state of the working machine (1) from the working machine side transmission/reception unit (21).

In further accordance with the present invention, the radio remote operation means (3) uses a dry-cell battery (39) as a power supply, and the display unit (33) has a function for displaying a cell remaining amount of the dry-cell battery (39).

In further accordance with the present invention, the radio remote operation means (3) controls the various operations of a plurality of the working machines.

Advantageous Effects of Invention

According to the arrangement of a first feature, since data showing the driving state of the working machine (1) is transmitted from the working machine side transmission/reception unit (21) to the remote operation side transmission/reception unit (31) only when the remote operation side transmission/reception unit (31) of the radio remote operation means (3) is in an operating state, the electric power consumption of the radio remote operation means (3) may be saved.

According to the arrangement of a second feature, the data showing the driving state of the working machine (1) may be continuously obtained by intermittently performed transmission/reception between the remote operation side transmission/reception unit (31) and the working machine side transmission/reception unit (21) by operating the remote operation side transmission/reception unit (31) at a transmission/reception interval previously set to a storage unit (322).

According to the arrangement of a third feature, the driving state of the working machine may be confirmed on the radio remote operation means (3) side by disposing a display unit (33) for displaying the data received by the remote operation side transmission/reception unit (31) as well as an operation for stopping the engine may be performed on the radio remote operation means (3) side by disposing an operation unit (34) for operating the stop of the engine.

According to the arrangement of a fourth feature, an electric power consumption may be saved on the radio remote operation means (3) side by temporarily stopping the functions except the functions for operating a timer (321) and the display unit (33) after the data showing the driving state of the working machine (1) is received from the working machine side transmission/reception unit (21).

According to the arrangement of a fifth feature, the state whether or not the radio remote operation means (3) is normally operable may be found by providing the display unit (33) with a function for displaying a remaining amount of a dry-cell battery (39).

According to the arrangement of sixth feature, the various controls of plural working machines may be performed by one radio remote operation means (3).

DESCRIPTION OF EMBODIMENTS

Figure 1:
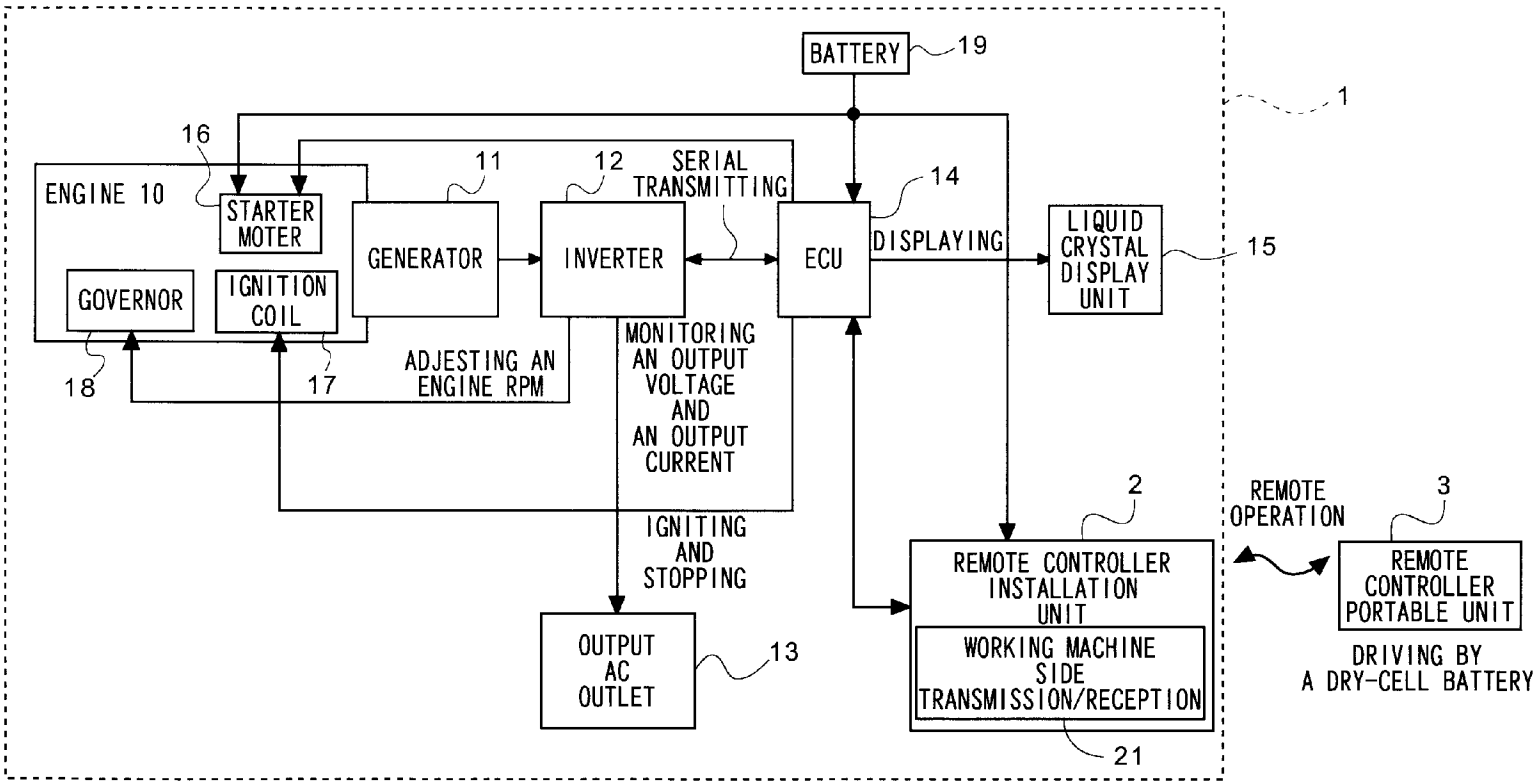
FIG. 1 is a block diagram of a working machine (engine generator) side of a remote operation apparatus of a working machine according to an embodiment of the invention.
Figure 2:
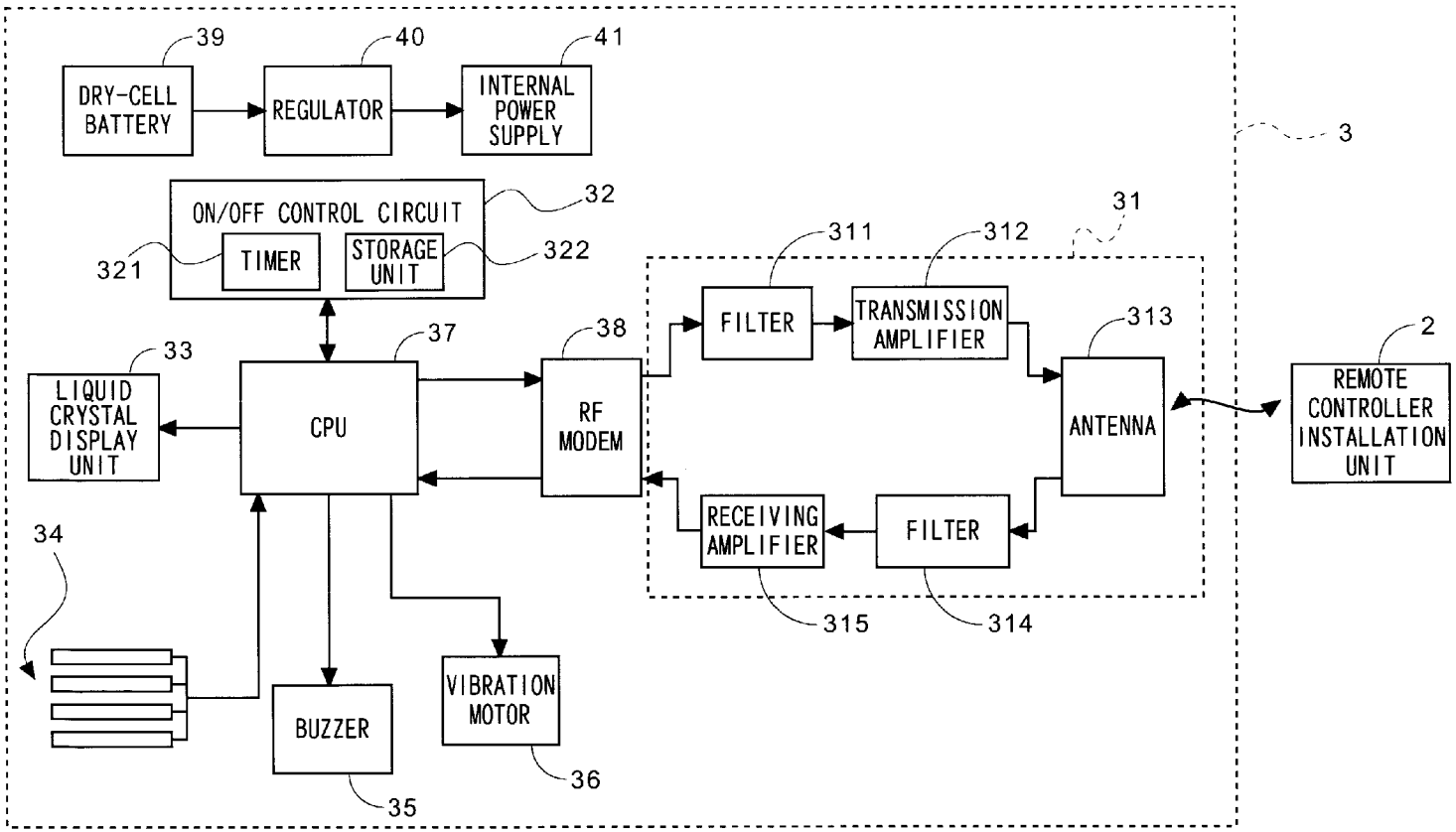
FIG. 2 is a block diagram of a remote controller unit (radio remote operation means) side of the remote operation apparatus of the working machine according to the embodiment of the invention.

An example of an embodiment of a remote operation apparatus of a working machine of the invention is described below by referring to FIGS. 1 and 2. In the embodiment, an example, in which the working machine is arranged as an engine generator, is described.

The remote operation apparatus of the working machine is composed of a working machine 1 having the engine generator (FIG. 1) and a remote controller portable unit (radio remote operation means) 3 (FIG. 2) for remotely operating the working machine 1. A remote controller installation unit 2 is disposed to the working machine 1 to transmit and receive a signal between the remote controller portable unit 3 and the remote controller installation unit 2.

The working machine 1 includes the engine generator, which has an engine 10 and a generator 11 driven by the engine, and the electric power generated by the generator 11 is supplied to an output AC outlet 13 through an inverter circuit 12. Electric equipment (not shown) operated by the engine generator is connected to the output AC outlet 13.

The working machine 1 includes an ECU (operation controller) 14 as an engine control unit which has a CPU for controlling the drive of the engine generator, a liquid crystal display unit 15 for displaying the operating state of the engine generator, a starter motor 16 for cranking the engine in response to a signal from the ECU 14, an ignition coil 17 for igniting and stopping the engine in response to a signal from the ECU 14, a governor 18 for adjusting a fuel injection amount based on an engine rpm, and a battery 19 for supplying a drive electric power to the starter motor 16 and acting as a power supply of the remote controller installation unit 2 and the ECU 14.

The ECU 14 is connected to the inverter circuit 12, to constantly detect the operating state of the engine generator by monitoring an output voltage and an output current by the inverter circuit 12, and the information of the operating state is output to the remote controller installation unit 2. A working machine side transmission/reception unit 21 is disposed to the remote controller installation unit 2, to modulate an information signal of the engine generator obtained from the ECU 14, and transmits (wirelessly transmits) a modulated information signal to the remote controller portable unit 3 as well as receives and detects an operation signal from the remote controller portable unit 3 to output a detected operation signal to the ECU 14 side.

The remote controller portable unit 3 includes a remote control side transmission/reception unit 31 for performing transmission/reception with the working machine side transmission/reception unit 21 of the remote controller installation unit 2, an ON/OFF control circuit 32 for controlling the operation/non-operation state of the remote control side transmission/reception unit 31, a liquid crystal display unit 33 for displaying the operating state of the engine generator, a switch group (operation unit) 34 composed of plural (four) switches for performing a start, a stop, and the like of the engine generator, a buzzer 35 for issuing a warning sound based on a signal from the working machine side transmission/reception unit 21 side, a vibration motor 36 for vibrating the remote controller portable unit 3 based on a signal from the working machine side transmission/reception unit 21 side, a CPU 37 for creating an operation signal to the remote controller installation unit 2 based on a signal from the switch group 34 as well as outputting a control signal to the liquid crystal display unit 33, the buzzer 35, and the vibration motor 36, and an RF modem 38 having a modulation unit for modulating the control signal from the CPU 37 and a detection unit for detecting a signal received by the remote control side transmission/reception unit 31.

The remote control side transmission/reception unit 31 wirelessly transmits an operation signal, which is created by the CPU 37 and modulated by the RF modem 38, from an antenna 313 through a filter 311 and a transmission amplifier 312 and receives a radio signal from the remote controller installation unit 2 by the antenna 313, to detect the received radio signal by the RF modem 38 through a filter 314 and a receiving amplifier 315, and to output a detected radio signal to the CPU 37.

The ON/OFF control circuit 32 controls the operation/non-operation state of the remote control side transmission/reception unit 31. When the ON/OFF control circuit 32 is turned on, the remote control side transmission/reception unit 31 becomes to an operating state, the working machine side transmission/reception unit 21 of the remote controller installation unit 2 is called, and the data (an actual machine information signal) showing the driving state of the working machine 1 is transmitted from the working machine side transmission/reception unit 21 to the remote control side transmission/reception unit 31.

Further, the ON/OFF control circuit 32 includes a timer 321 for controlling transmission/reception timing with the working machine side transmission/reception unit 21, and a storage unit 322. A transmission/reception interval is previously set to the storage unit 322 to intermittently performing transmission/reception with the working machine side transmission/reception unit 21 by intermittently operating the remote control side transmission/reception unit 31.

The data (the actual machine information signal) showing the driving state of the working machine 1 is intermittently transmitted from the working machine side transmission/reception unit 21 by that the remote control side transmission/reception unit 31 intermittently performs the transmission/reception. In this case, after the CPU 37 of the remote controller portable unit 3 receives the data (the actual machine information signal) showing the driving state of the working machine 1, the CPU 37 performs a control for temporarily stopping the functions other than the function for operating the timer 321 and the liquid crystal display unit 33 until the timing for the next transmission/reception set to the storage unit 322.

The remote controller portable unit 3 includes an internal power supply 41 for supplying electric power from a dry-cell battery 39 to the respective units of the remote controller portable unit 3 through a regulator 40.

Figures 3, 4:
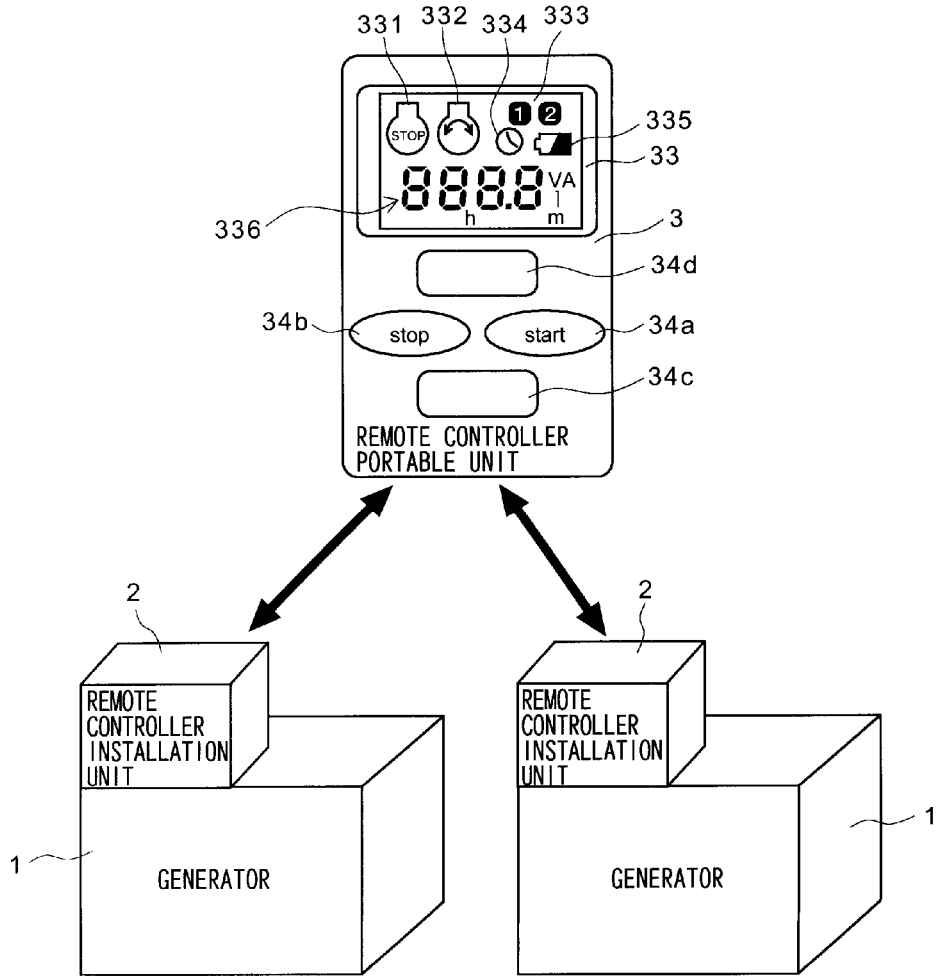
FIG. 3 shows remote operation signal formats transmitted and received between a remote controller installation unit and the remote controller portable unit, wherein (a) shows a transmission signal of the remote controller portable unit, and (b) shows a transmission signal of the remote controller installation unit, respectively.
FIG. 4 is an explanatory view of an appearance of the remote operation apparatus of the working machine according to the embodiment of the invention.

FIG. 3 shows formats of a remote operation signal wirelessly transmitted between the remote controller installation unit 2 and the remote controller portable unit 3.

A transmission signal of the remote controller portable unit 3 is composed of an ID code, a command, and a check SUM each having plural bits. The "ID code" is an address code for identifying the working machine 1 when plural working machines are remotely operated, the "command" is a control code for performing a control such as a "start", a "stop", and the like to the engine generator of the working machine 1, and the "check SUM" is a signal for checking whether or not a signal is successfully transmitted and received between the remote controller portable unit 3 and the remote controller installation unit 2 by multiplying the "ID code" and a "command" signal. Further, the "command" has the information of a response request time which is a time until the working machine side transmission/reception unit 21 responds to the remote control side transmission/reception unit 31.

A transmission signal of the remote controller installation unit 2 is composed of an ID code, a command, actual machine information, and a check SUM each having plural bits. The "ID code" is an address code for identifying a working machine, the "command" is signal for performing various displays on the liquid crystal display unit 33, and the "actual machine information" is an information signal for transmitting the operation information of the working machine 1.

Figure 5:
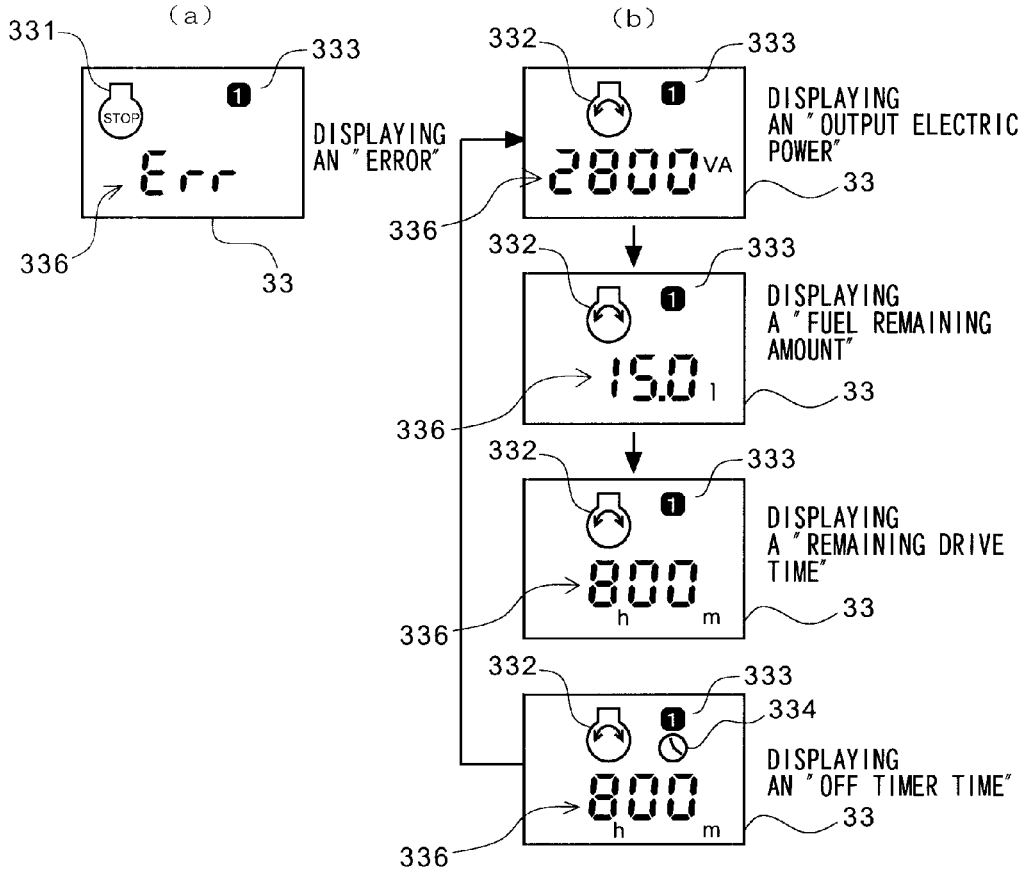
FIGS. 5(*a*) and (*b*) are explanatory views when various information is shown on a liquid crystal display unit of the remote controller portable unit.

Next, specific arrangements of the liquid crystal display unit 33 and the switch group 34 of the remote controller portable unit 3 are described by referring to FIGS. 4 and 5.

As shown in FIG. 4, two sets of the working machines 1 (each of which is an engine generator having the remote controller installation unit 2) may be registered by one set of the remote controller portable unit 3, and the two sets of the working machines 1 may be remotely operated in parallel with each other.

The liquid crystal display unit 33 having a rectangular shape is formed to an upper part of a panel surface of the remote controller portable unit 3 so that it may display various information of the working machine such as an "output electric power" for displaying the output power generated by the engine generator, a "fuel remaining amount" for displaying a fuel amount remained, a "remaining drive time" for displaying how many hours and minutes the engine generator may be driven in a present output power, an "OFF timer time" for stopping the engine after the time at which the timer is set, and an "occurrence of error" for warning occurrence of an abnormal state on the engine generator side.

The liquid crystal display unit 33 may display a stop mark 331 for notifying the state that the engine generator stops, a drive mark 332 for notifying that the engine generator is driving, a working machine identification mark 333 for identifying a working machine to be remotely operated, a clock mark 334 for notifying that the OFF timer is set, a dry-cell battery replacement time mark 335 for displaying the cell remaining amount of the dry-cell battery 39, a 4-digit numeral display unit 336, and "VA", "I" and "h m" which are lit depending on a type of information displayed.

Push button switches 34*a*, 34*b*, 34*c*, and 34*d* are formed, respectively at lower positions of the liquid crystal display unit 33 of the panel surface of the remote controller portable unit 3. The engine generator of the working machine 1 is "started" by "pressing" the switch 34*a*, the engine generator is "stopped" by "pressing" the switch 34*b*, the working machine 1, which is remotely operated and the driving state of which is displayed, "is switched" by "pressing for a long time" the switch 34*c*, and a "display item change" of information is performed by "pressing for a short time" the switch 34*d*.

When an abnormal state occurs on the working machine 1 side and the liquid crystal display unit 33 of the remote controller portable unit 3 displays "occurrence of error", the working machine identification mark 333, the stop mark 331, and letters "Err" on the numeral display unit 336 are displayed as shown in FIG. 5(*a*). At the same time, "occurrence of error" is notified by the warning sound of the buzzer 35 and the vibration of the remote controller portable unit 3 generated by the vibration motor 36.

To display "output electric power" of the engine generator on the liquid crystal display unit 33, the working machine identification mark 333, the drive mark 332, the numeral display unit 336, and the letters "VA" are displayed as shown in FIG. 5(*b*).

To display "fuel remaining amount", the working machine identification mark 333, the drive mark 332, the numeral display unit 336, and the letter "I" are displayed. To display "remaining drive time" the working machine identification mark 333, the drive mark 332, the numeral display unit 336, and the letters "h m" are displayed, and to display "OFF timer time", the working machine identification mark 333, the drive mark 332, the clock mark 334, the numeral display unit 336, and the letters "h m" are displayed.

The displays of the "output electric power", the "fuel remaining amount", the "remaining drive time", and the "OFF timer time" rotates each time the switch 34*d* is "pressed for a short time" as shown in FIG. 5(*b*).

The remote controller installation unit 2 constantly communicates with the ECU 14 of the working machine 1 and obtains the information (the output electric power, the fuel remaining amount, the remaining drive time, the OFF timer time, and the error code) of the engine generator. Further, the information is transmitted to the remote controller portable unit 3 when needed and becomes displayable on the liquid crystal display unit 33 of the remote controller portable unit 3.

The remote controller installation unit 2 is driven by the battery 19 and constantly obtains the information of the engine generator, whereas the remote controller portable unit 3 is driven by the dry-cell battery 39, and the remote control side transmission/reception unit 31 is operated by the ON/OFF control circuit 32 only when needed.

Further, the liquid crystal display unit 15 disposed to the working machine 1 side displays real time information on the present operating state of the engine generator obtained by the ECU 14. The information is arranged, for example to simultaneously display the various information (the information of the output electric power, the fuel remaining amount, the remaining drive time, and the like) on the liquid crystal display unit 33 of the remote controller portable unit 3.

Figure 6:
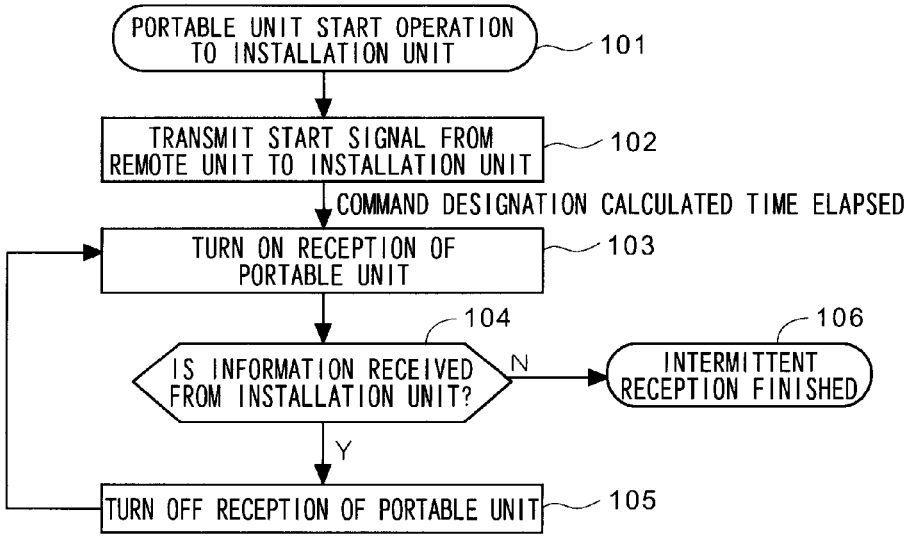
FIG. 6 is a flowchart when one working machine is remotely operated using the remote controller portable unit.
Figure 7:
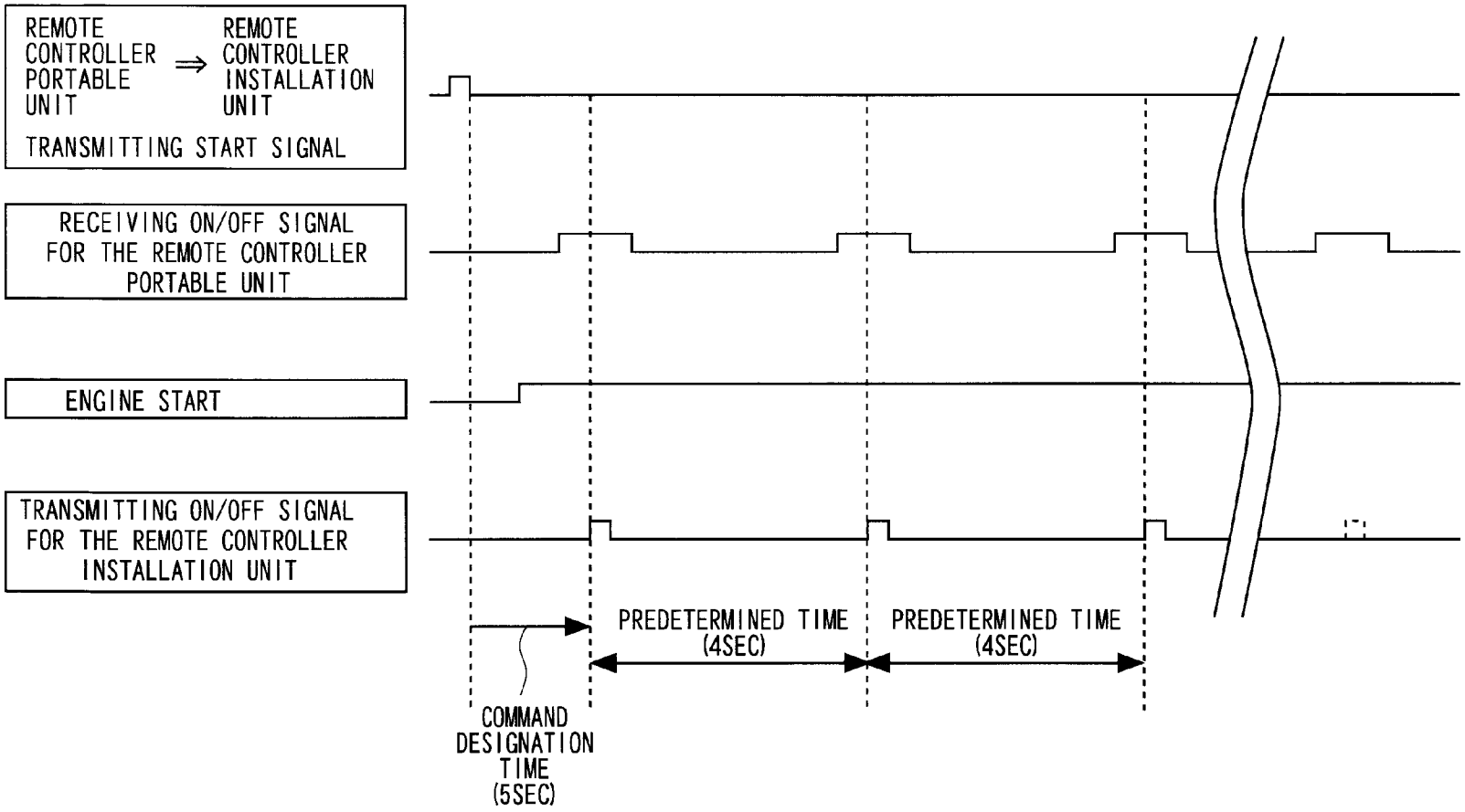
FIG. 7 is a timing chart when the one working machine is remotely operated using the remote controller portable unit.

An operation of the remote operation apparatus of the working machine 1 arranged as described above is described by referring to a flowchart of FIG. 6 and a timing chart of FIG. 7.

When an operator performs a start operation by pressing the switch 34*a* of the remote controller portable unit 3 for performing a "starting" of the engine generator (step 101), a transmission signal shown in FIG. 3(*a*) is created in the remote controller portable unit 3 and transmitted to the remote controller installation unit 2 as an operation signal (start signal) of a modulated radio signal (step 102).

The start signal includes a response request time (previously set to, for example, 5 seconds as a command designation time) until the remote controller installation unit 2 responds to the remote controller portable unit 3, along with the ID code for identifying the working machine 1 and a start command.

On the working machine 1 side, the working machine side transmission/reception unit 21 of the remote controller installation unit 2 receives and detects the start signal, compares the start signal with the ID address of the working machine 1, and when the start signal matches the ID address, the working machine side transmission/reception unit 21 acknowledges that the start signal is an operation signal for the working machine 1 and starts the engine generator controlling the starter motor 16 and the ignition coil 17 through the ECU 14.

The response request time (command designation time) is automatically set to a time, which is longer than the time from the working machine side transmission/reception unit 21 to receive the start signal until the engine to start, by the CPU 37 of the remote controller portable unit 3. After the response request time (command designation time) has elapsed, the remote controller installation unit 2 returns a signal (actual machine information signal) including the operation information of the engine generator to the remote controller portable unit 3 (step 103). Thereafter, the remote controller installation unit 2 transmits the actual machine information signal including the driving state (output electric power and the like) of the engine generator at each predetermined time (for example, 4 seconds) (step 104).

On the remote controller portable unit 3 side, the remote control side transmission/reception unit 31 is set so as to be intermittently turned on by the ON/OFF control circuit 32 in response to a reception ON/OFF signal so that the period, during which the actual machine information signal (a transmission ON/OFF signal of the installation unit of FIG. 7) is transmitted each predetermined time, is to be included (refer to FIG. 7).

More specifically, on the remote controller portable unit 3 side, the remote control side transmission/reception unit 31 is turned on by the ON/OFF control circuit 32 in response to the reception ON/OFF signal at the interval set to the storage unit 322, and the remote control side transmission/reception unit 31 receives the actual machine information signal from the working machine side transmission/reception unit 21 of the remote controller installation unit 2 after the set response request time has elapsed.

Thereafter, the actual machine information signal is intermittently received by turning on the remote control side transmission/reception unit 31 each predetermined time (4 seconds) from the time at which the actual machine information signal is received from the remote controller installation unit 2 (steps 105 and 103), and the intermittent reception is finished when the switch 34*b* is pressed and no information is received from the remote controller installation unit (S106).

When the remote controller portable unit 3 does not receive the signal from the remote controller installation unit 2 at scheduled timing (when a transmission signal ON/OFF signal of the installation unit of FIG. 7 is shown by a dotted line), the remote controller portable unit 3 stops a reception process thereafter, and a communication error is displayed on the liquid crystal display unit 33 (FIG. 5(*a*)).

The information of the ECU 14 on the working machine 1 side may be received on the remote controller portable unit 3 side at the predetermined interval by performing the intermittent reception by the remote control side transmission/reception unit 31 as described above. Accordingly, the operating state of the engine generator may be continuously obtained, as well as since the remote control side transmission/reception unit 31 on the remote controller portable unit 3 side is intermittently turned on, the electric power consumption of the remote controller portable unit 3 is reduced and the cell life of the dry-cell battery 39 is increased so that the remote controller portable unit 3 may be used for longer time to thereby improve convenience.

Figure 8:
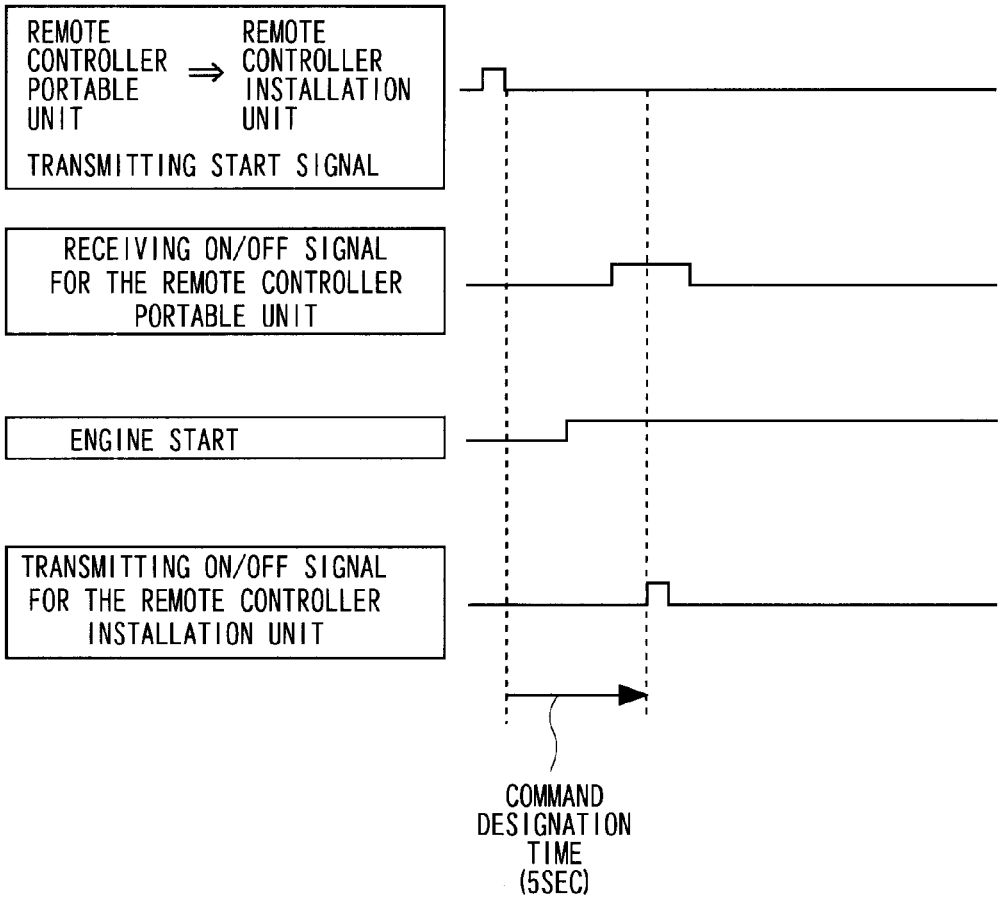
FIG. 8 is a timing chart when the one working machine is remotely operated using the remote controller portable unit (an example in which no intermittent reception is performed).

FIG. 8 shows another example of the operation of the remote operation apparatus of the working machine, wherein the information from the remote controller installation unit 2 side is transmitted only once in response to a request from the remote controller portable unit 3 side in place of the intermittent reception on the remote controller portable unit 3 side.

More specifically, when the operator performs a start operation by pressing the switch 34*a* of the remote controller portable unit 3 for performing a "start" of the engine generator, a start signal as a radio signal is sent from the remote controller portable unit 3 to the remote controller installation unit 2 likewise FIG. 7.

The start signal includes a response request time (for example, 5 seconds are previously set as a command designation time) until the remote controller installation unit 2 responds to the remote controller portable from unit 3, and, on the working machine 1 side, the working machine side transmission/reception unit 21 of the remote controller installation unit 2 receives the start signal and starts the engine generator by controlling the starter motor 16 and the ignition coil 17 through the ECU 14.

Then, a time, which is longer than the time from the working machine side transmission/reception unit 21 to receive the start signal until the engine to start, is automatically set as the response request time (command designation time) by the CPU 37 of the remote controller portable unit 3 as well as the ON/OFF control circuit 32 is controlled to be turned on in the period during which the response (actual machine information signal) is transmitted from the remote controller installation unit 2.

Although the operating state on the working machine side is confirmed just after the engine starts in the example of FIG. 8, the operator may confirm the operating state (an actual machine state confirmation) on the working machine side at an arbitrary time when needed in addition to the above confirmation. For example, the response request time (command designation time) is automatically set by the CPU 37 of the remote controller portable unit 3 by "pressing for a long time" the switch 34*d* of the remote controller portable unit 3, and the ON/OFF control circuit 32 is controlled so that it is turned on in the period during which the response (actual machine information signal) from the remote controller installation unit 2 is transmitted.

According to the example, after the response request time (command designation time) has elapsed, the remote control side transmission/reception unit 31 is turned on only once when the engine generator starts or after the actual machine state is confirmed, and thereafter the remote control side transmission/reception unit 31 is turned off. As a result, an electric power may be further saved compared with the intermittent reception of FIG. 7.

Figure 9:
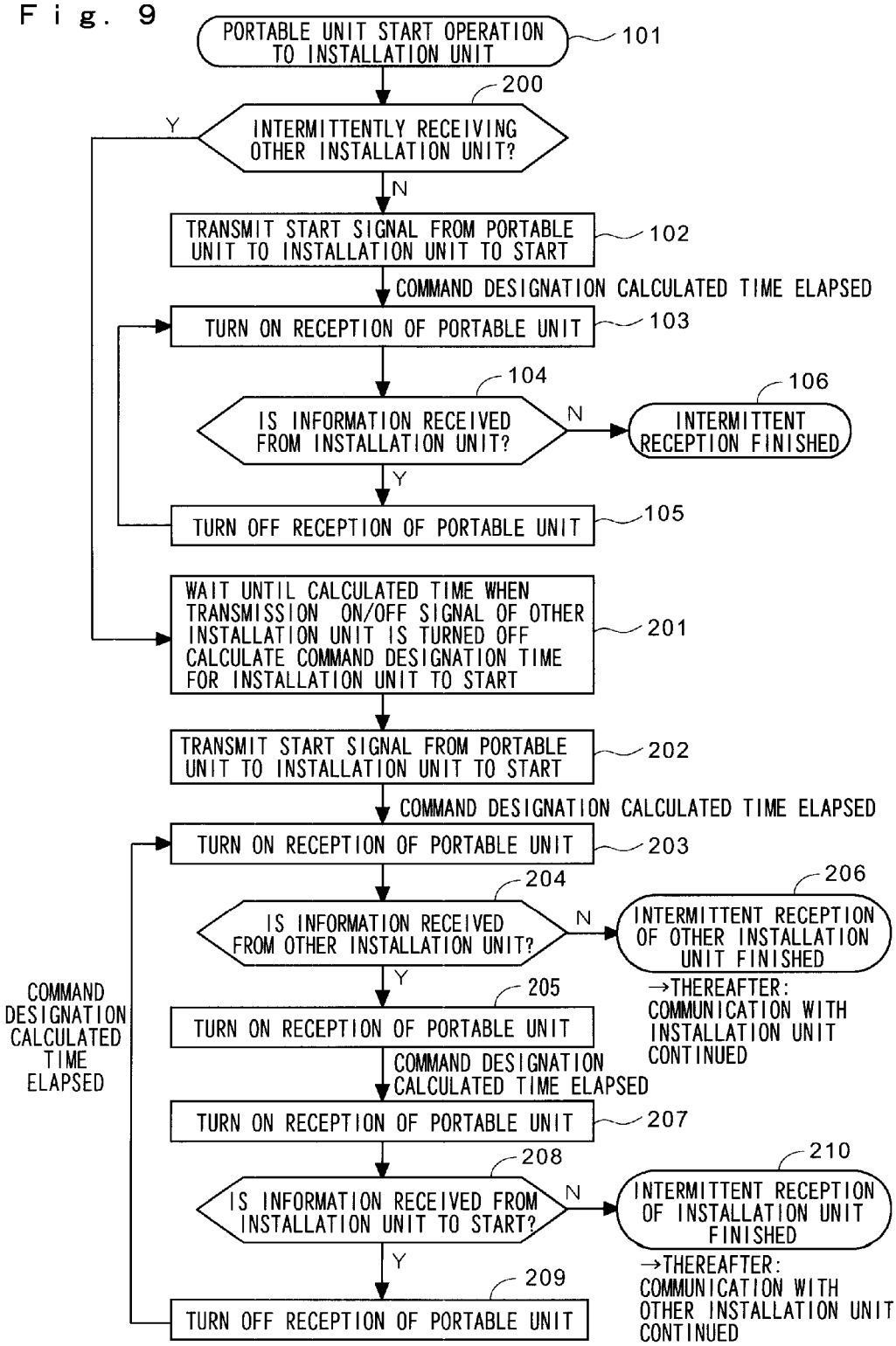
FIG. 9 is a flowchart when two working machines are remotely operated using the remote controller portable unit.
Figure 10:
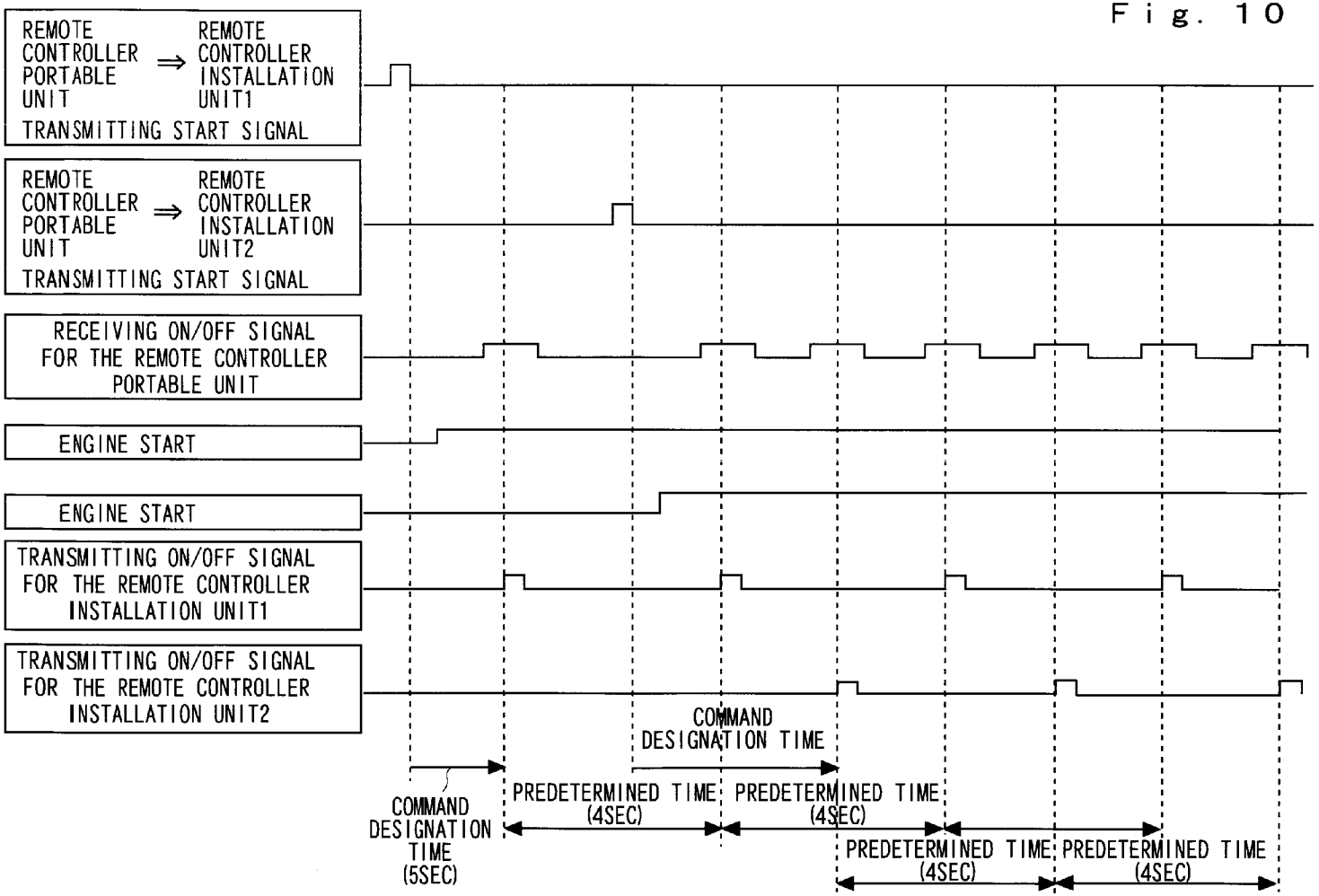
FIG. 10 is a timing chart when the two working machines are remotely operated using the remote controller portable unit.

Next, a case where one remote controller portable unit 3 controls two working machines 1 having remote controller installation units 2 (shown as an installation unit "1" and an installation unit "2"), respectively, is described by referring to a flowchart of FIG. 9 and a timing chart view of FIG. 10.

FIGS. 9 and 10 show an example that the working machine 1 having the installation unit "1" is operated first and thereafter the working machine 1 having the installation unit "2" is operated. In FIG. 9, steps having the same contents as those of FIG. 6 are denoted by the same reference numerals.

When the operator selects a working machine 1 (for example, the installation unit "1") by "pressing for a long time" the switch 34*c* and performs a start operation by pressing the switch 34*a* for performing a "start" of an engine generator (step 101), first, it is determined whether or not the remote control side transmission/reception unit 31 of the remote controller portable unit 3 is performing an intermittent reception with the other installation unit (in this case, the installation unit "2") (step 200).

When the remote control side transmission/reception unit 31 is not performing the intermittent reception with the other installation unit, processes are performed at steps 102 to 106 which are the same as those of FIG. 6.

In this state (in the state where the installation unit "1" is being operated), when the operator selects the installation unit "2" by switching the working machine 1 by the remote controller portable unit 3 and performs a start operation by pressing the switch 34*a* for performing the "start" of the engine generator (step 101), it is determined whether or not the remote control side transmission/reception unit 31 of the remote controller portable unit 3 is performing an intermittent reception with the other installation unit (in this case, the installation unit "1") (step 200). Since the installation unit "1" is in an operating state (intermittent reception state), it is stood by until a calculated time, during which a transmission ON/OFF signal of the other installation unit (the installation unit "1") is turned off, has elapsed. At the same time, a command designation time (a time longer than the time from the working machine side transmission/reception unit 21 to receive a start signal until an engine to start) to the installation unit (the installation unit "2") is calculated by the CPU 37 of the remote controller portable unit 3 so that the pulse (ON signal) of the transmission ON/OFF signal of the installation unit (the installation unit "2") to be subjected to the START operation is located at an intermediate position of the pulse (ON signal) of the transmission ON/OFF signal of the other installation unit (the installation unit "1") (step 201).

Then, a START signal is transmitted from the remote controller portable unit 3 to the installation unit (the installation unit "2") at the timing when a calculated command designation time to the installation unit (the installation unit "2") is located at the intermediate position of the pulse (ON signal) of the transmission ON/OFF signal of the other installation unit (the installation unit "1") (step 202).

On the remote controller portable unit 3 side, the reception ON/OFF signal of the remote controller portable unit 3 is turned on corresponding to a command designation calculated time (pulse (ON signal) generation time of the transmission ON/OFF signal of the installation unit "1") to the installation unit (the installation unit "2") to which the START operation is performed (step 203).

According to the above operation, a signal (an actual machine information signal) including the operation information of the engine generator is returned to the remote controller portable unit 3 in response to the transmission ON/OFF signal of the other installation unit (the installation unit "1") (step 204).

When the actual machine information signal is transmitted, the reception ON/OFF signal of the remote controller portable unit 3 is turned off thereafter (step 205).

When the switch 34*b* is pressed and no actual machine information signal is transmitted from the remote controller installation unit, the intermittent reception of the other installation unit (the installation unit 1) is finished (step 206).

After the reception ON/OFF signal of the remote controller portable unit 3 is turned off, the reception ON/OFF signal is turned on corresponding to the pulse (ON signal) of the transmission ON/OFF signal of the installation unit "2" which is generated after the command designation time has elapsed from the START signal to the command designation calculated time (the installation unit "2") (step 207).

Accordingly, the signal (the actual machine information signal) including the operation information of the engine generator is returned to the remote controller portable unit 3 in response to the transmission ON/OFF signal of the other installation unit (the installation unit "2") subjected to the START operation (step 208).

When the actual machine information signal is transmitted, the reception ON/OFF signal of the remote controller portable unit 3 is turned off thereafter (step 209).

When the switch 34*b* is pressed and no actual machine information signal is transmitted from the remote controller installation unit 3, the intermittent reception of the installation unit (the installation unit "2") subjected to the START operation is finished (step 210).

After the reception ON/OFF signal of the remote controller portable unit 3 is turned off, the reception ON/OFF signal is turned on after the command designation calculated time (2 seconds which is a half of the predetermined time of 4 seconds) has elapsed (203), and the processes described above are continuously performed. As shown in a timing chart of FIG. 10, the installation units "1" and "2" alternately transmit the actual machine information signals of the respective engine generators of the two working machines 1 having either of the installation unit "1" or the installation unit "2" at each predetermined time (4 seconds). As a result, the operating state and occurrence of an abnormal state of the respective working machines 1 may be obtained approximately at a real time.

In structure of the remote controller portable unit (radio remote operation means) 3 described above, although the various switches 34*a* to 34*d* are disposed as the switch group (operation unit) 34 and the start of the engine generator of the working machine 1 is enabled by providing the switch 34*a*, the structure of the remote controller portable unit may be such that only the switch 34*b* for performing an operation for stopping the engine may be provided.

According to the remote operation apparatus of the working machine having the structure described above, an electric power consumption is reduced by turning on the remote control side transmission/reception unit 31 of the remote controller portable unit 3 only when needed so that the operation duration of the remote controller portable unit 3 driven by the dry-cell battery 39 may be prolonged.

The invention claimed is:

1. A remote operation apparatus comprising an operation controller that cooperates with a plurality of working machines to control various operations of the plurality of working machines, each of said plurality of working machines having an associated engine and an associated working machine side transmission/reception unit, said operation controller including a radio remote operation device having a remote control side transmission/reception unit for performing transmission/reception with the working machine side transmission/reception unit of each of said plurality of working machines being remotely operated, said remote operation apparatus comprising:

an ON/OFF control circuit for controlling transmission/reception timing with the working machine side transmission/reception unit of the working machine being remotely operated and operation/non-operation state of the remote control side transmission/reception unit is disposed to the radio remote operation device;

wherein the working machine side transmission/reception unit of the working machine being remotely operated is called when the remote control side transmission/reception unit is in an operating state in which the ON/OFF control circuit is turned on, and data showing the driving state of the working machine being remotely operated is transmitted from the working machine side transmission/reception unit of the working machine being remotely operated to the remote control side transmission/reception unit; and, a display unit for displaying the data received by the remote control side transmission/reception unit and for displaying a working machine identification mark that identifies which of the plurality of working machines is being remotely operated, wherein when said remote operation apparatus determines that said remote control side transmission/reception unit is performing intermittent reception with one of said plurality of working machines, transmission/reception with another of said plurality of working machines is delayed until a predetermined time has elapsed; and, said remote control side transmission/reception unit calculates a command designation time so that a pulse ON signal of the transmission ON/OFF signal of the working machine to be subjected to a START operation is located at an intermediate position of the pulse ON signal of the transmission ON/OFF signal of the other working machine.

2. The remote operation apparatus of the working machine according to claim 1, wherein the ON/OFF control circuit includes a timer and a storage unit for controlling timing of transmission/reception between the working machine side transmission/reception unit of the working machine being remotely operated and the remote control side transmission/reception unit; and the transmission/reception between the working machine side transmission/reception unit of the working machine being remotely operated and the remote control side transmission/reception unit is intermittently performed by operating the remote control side transmission/reception unit at a transmission/reception interval previously set to the storage unit.

3. The remote operation apparatus of the working machine according to claim 1, wherein the radio remote operation device comprises:

an operation unit for at least stopping the engine.

4. The remote operation apparatus of the working machine according to claim 2, wherein the radio remote operation device comprises:

an operation unit for at least stopping the engine.

5. The remote operation apparatus of the working machine according to claim 2, wherein the radio remote operation device has a function for temporarily stopping functions other than a function for operating the timer and the display unit until the timing of next transmission/reception performed by the storage unit after the radio remote operation device receives the data showing the operating state of the working machine being remotely operated from the working machine side transmission/reception unit of that working machine.

6. The remote operation apparatus of the working machine according to claim 3, wherein the radio remote operation device has a function for temporarily stopping functions other than a function for operating the timer and the display unit until the timing of next transmission/reception performed by the storage unit after the radio remote operation device receives the data showing the operating state of the working machine being remotely operated from the working machine side transmission/reception unit of that working machine.

7. The remote operation apparatus of the working machine according to claim 3, wherein the radio remote operation device uses a dry-cell battery as a power supply, and the display unit has a function for displaying a cell remaining amount of the dry-cell battery.

8. The remote operation apparatus of the working machine according to claim 3, wherein the ON/OFF control circuit includes a timer and a storage unit for controlling timing of transmission/reception between the working machine side transmission/reception unit of the working machine being remotely operated and the remote control side transmission/reception unit; and the transmission/reception between the working machine side transmission/reception unit of the working machine being remotely operated and the remote control side transmission/reception unit is intermittently performed by operating the remote control side transmission/reception unit at a transmission/reception interval previously set to the storage unit.

9. The remote operation apparatus of the working machine according to claim 8, wherein the radio remote operation device has a function for temporarily stopping functions other than a function for operating the timer and the display unit until the timing of next transmission/reception performed by the storage unit after the radio remote operation device receives the data showing the operating state of the working machine being remotely operated from the working machine side transmission/reception unit of that working machine.

10. The remote operation apparatus of the working machine according to claim 9, wherein the radio remote operation device uses a dry-cell battery as a power supply, and the display unit has a function for displaying a cell remaining amount of the dry-cell battery.

* * * * *